US006447558B1

(12) United States Patent
Yeh et al.

(10) Patent No.: US 6,447,558 B1
(45) **Date of Patent: *Sep. 10, 2002**

(54) DIESEL FUEL COMPOSITION

(75) Inventors: Lisa I-Ching Yeh, Marlton; Richard Henry Schlosberg, Bridgewater, both of NJ (US); Richard C. Miller, Baton Rouge, LA (US); Raf F. Caers, Edegem (BE)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/732,455

(22) Filed: Dec. 7, 2000

Related U.S. Application Data

(60) Provisional application No. 60/172,912, filed on Dec. 21, 1999.

(51) Int. Cl.[7] ..... C10L 1/18

(52) U.S. Cl. ..... 44/437; 44/438; 44/439; 44/451; 44/452

(58) Field of Search ..... 44/437, 438, 439, 44/451, 452

(56) References Cited

U.S. PATENT DOCUMENTS

| | | | | |
|---|---|---|---|---|
| 4,207,078 A | * | 6/1980 | Sweeney et al. | |
| 4,378,973 A | | 4/1983 | Sweeney | 44/56 |
| 4,632,675 A | | 12/1986 | Davies et al. | 44/72 |
| 5,004,478 A | | 4/1991 | Vogel et al. | 44/398 |
| 5,308,365 A | | 5/1994 | Kesling, Jr. et al. | 44/447 |
| 5,324,335 A | | 6/1994 | Benham et al. | 44/452 |
| 5,425,790 A | | 6/1995 | Liotta, Jr. et al. | 44/443 |
| 5,645,613 A | | 7/1997 | Benham et al. | 44/452 |
| 5,689,031 A | * | 11/1997 | Berlowitz et al. | 585/734 |
| 5,720,784 A | | 2/1998 | Killick et al. | 44/451 |

FOREIGN PATENT DOCUMENTS

| | | | |
|---|---|---|---|
| EP | 0115382 | 8/1984 | C10G/27/12 |
| EP | 0376453 | 7/1990 | C07C/27/16 |
| EP | 0905217 | 3/1999 | C10L/1/02 |
| WO | WO92/20761 | 11/1992 | C10L/1/02 |
| WO | WO93/24593 | 12/1993 | C10L/1/18 |
| WO | WO96/23855 | 8/1996 | C10L/1/14 |
| WO | WO98/05740 | 2/1998 | C10L/1/08 |
| WO | WO98/34998 | 8/1998 | C10L/1/08 |
| WO | WO98/35000 | 8/1998 | C10L/1/18 |
| WO | WO99/21943 | 5/1999 | C10L/1/18 |

OTHER PUBLICATIONS

"New Findings on Combustion Behavior of Oxygenated Synthetic Diesel Fuels", C. Beatrice et al, Combustion Science and Technology, 1998, vol. 137, pp. 31–50.

"The Effect of Oxygenated Fuels on Emissions from a Modern Heavy–Duty Diesel Engine", F. Liotta, Jr. et al, SAE 932734 (Oct. 18–21, 1993).

"Improvement of Diesel Combustion and Emissions with Addition of Various Oxygenated Agents to Diesel Fuels", N. Miyamoto et al, SAE 962115 (Oct. 14–17, 1996).

"The Effects of Fuel Properties and Oxygenates on Diesel Exhaust Emissions", K. Tsurutani et al, SAE 952349 (Oct. 16–19, 1995).

"Effects of Oxygenated Fuel and Cetane Improver on Exhaust Emission from Heavy–Duty DI Diesel Engines", Y. Akasaka et al, SAE 942023 (Oct. 17–20, 1994).

* cited by examiner

*Primary Examiner*—Margaret Medley
(74) *Attorney, Agent, or Firm*—Joseph J. Allocca

(57) ABSTRACT

This invention is a method of reducing particulate matter emission from internal combustion engines which use a diesel fuel composition comprising a major amount of a diesel fuel having a base fuel which contains no more than 10% by weight of olefins and no more than 10% by weight of esters, by admixing said fuel with greater than 5% by weight based on the total composition of a saturated, aliphatic monohydric alcohol having on an average from 4 to 20 carbon atoms, one or more ketones having on an average 5 to 25 carbons and mixture of said alcohol(s) and ketone(s). The amount of the oxygenate in the fuel composition is sufficient to provide the fuel with at least 0.5% by weight of oxygen. The oxygenate significantly reduce particulate emissions from the exhausts of diesel powered engines.

11 Claims, 2 Drawing Sheets

DIESEL FUEL COMPOSITION

CROSS REFERENCE TO RELATED APPLICATION

This application claims the benefit of U.S. provisional application No. 60/172,912 filed Dec. 21, 1999.

This invention relates to a method of reducing particulate emissions from the exhausts of internal combustion engines powered by diesel fuels.

Of particular interest are fuels such as diesel which are used widely in automotive transport and for providing power for heavy duty equipment due to their high fuel economy. However, one of the problems when such fuels are burned in internal combustion engines is the pollutants in the exhaust gases that are emitted into the environment. For instance, some of the most common pollutants in diesel exhausts are nitric oxide and nitrogen dioxide (hereafter abbreviated as "$NO_x$"), hydrocarbons and sulphur dioxide, and to a lesser extent carbon monoxide. In addition, diesel powered engines also generate a significant amount of particulate emissions which include inter alia soot, adsorbed hydrocarbons and sulphates, which are usually formed due to the incomplete combustion of the fuel and are hence the cause of dense black smoke emitted by such engines through the exhaust. The oxides of sulphur have recently been reduced considerably by refining the fuel, e.g., by hydrodesulphurization thereby reducing the sulphur levels in the fuel itself and hence in the exhaust emissions. However, the presence of particulate matter in such exhaust emissions has been a more complex problem. It is known that the primary cause of the particulate matter emission is incomplete combustion of the fuel and to this end attempts have been made to introduce into the fuel organic compounds which have oxygen value therein (hereafter referred to as "oxygenates") to facilitate combustion. Oxygenates are known to facilitate the combustion of fuel to reduce the particulate matter. Examples of such compounds include some of the lower aliphatic esters such as, e.g., the ortho esters of formic and acetic acid, ethers, glycols, polyoxyalkylene glycols, ethers and esters of glycerol, and carbonic acid esters. For instance, U.S. Pat. No. 5,308,365 describes the use of ether derivatives of glycerol which reduce particulate emissions when added to diesel fuel. This patent teaches that the amount of reduction in particulate matter is linearly proportional to the oxygen content of the added components, i.e., the greater the oxygen content the higher are the reductions in particulate matter for a range of added compounds and that it is independent of the specific compound chosen over the range described.

Similarly, Society of Automotive Engineering paper 932734 summarizes a heavy-duty diesel engine study over a broader range of oxygenated fuels and one of the authors (Liotta, F J) is also one of the inventors of U.S. Pat. No. 5,425,790 (alcohols and glycols) and U.S. Pat. No. 5,308,365 (glycerol ethers and esters). The authors confirm that the amount of reduction in particulate matter scales roughly linearly with the oxygen content of the component added although ethers seem to be more effective for reducing particulates than alcohols for the same oxygen content.

Again, SAE Paper No. 942023 teaches the use of alcohols generically disclosed as A and B. This paper however fails to identify the alcohols tested.

Similarly, U.S. Pat. No. 5,425,790 (corresponding to SAE 932734) discloses the use of cyclohexyl ethanol and methyl benzyl alcohol as additives for fuels to reduce particulate emissions and states that these do not work (col. 6, lines 53–57). No other alcohols are disclosed. This reference which is primarily concerned with testing glycols and glycol ethers, does not state in what concentration the alcohols were tested.

U.S. Pat. No. 4,378,973 discloses the use of a combination of cyclohexane and an oxygenated additive for reducing particulate emissions from fuels. This document states that the beneficial effect cannot be achieved in the absence of cyclohexane. This document discloses 2-ethyl hexanol and "EPAL 1012" which comprises a mixture of normal C6–C20 alcohols as the oxygenated additives.

A further reference, WO 93/24593, is primarily concerned with gasohol blends from diesel and alcohols. This blend must contain 20–70% by volume of ethanol or methanol, 1–15% by volume of a tertiary alkyl peroxide and 4.5–5.5% by volume of a higher straight chain alcohol. The straight chain alcohols disclosed have from 3–12 carbon atoms. According to this reference the presence of a tertiary alkyl peroxide is essential for the performance of the fuel since using 10% v/v alcohol performs no better than a straight diesel whereas 30% v/v of ethanol "severely degraded the engine's operation" (page 8, lines 14–19).

WO 98/35000 relates to lubricity enhancing agents and makes no mention of controlling or reducing emission of particulate matter. This document discloses the use of primary, linear C7+alcohols in an amount of <5% w/w of a diesel fuel composition.

Similarly, WO 96/23855 relates to the use of glycol ethers and esters as lubricity enhancing additives to fuel oils such as diesel. There is no mention of using any alcohols as such although several alcohols have been listed as being used to prepare the ethers and esters.

Like the WO 96/23855 above, U.S. Pat. No. 5,004,478 refers to the use of polyethers and esters of aromatic carboxylic acids in diesel fuels as additives. There is no mention of the use of any alcohols as additives.

U.S. Pat. Nos. 5,324,335 and 5,465,613 both in the name of the same assignee relate to fuels produced by the Fischer-Tropsch process which also contain inter alia alcohols formed in situ in the process which is recycled to the process. Whilst several primary alcohols are disclosed most of these are linear except the reference to methyl butanol and methyl pentanol. However, the streams recycled contain a considerable amount of other components such as, e.g., aldehydes, ketones, aromatics, olefins, etc. Also, the amount of alcohols generated by this process, especially the content of branched alcohols (<0.5%), appears to be very low in relation to the total stream recycled.

U.S. Pat. No. 5,720,784 refers to fuel blends and the difficulty in rendering diesel fuels miscible with the conventionally used methanol and ethanol. This document purports to mitigate the problem of miscibility by adding to such formulations a $C_3$ (excluding n-propanol)-$C_{22}$ organic alcohol. However, whilst the document refers to the use of higher alcohols to form single phase compositions which are not prone to separation, it is silent on the nature of the diesel fuel—for these can vary significantly in their composition from light naphtha to heavy duty diesel oils—nor indeed the effect of any of the alcohols referred to on the problems of particulate emissions when using such fuels in diesel fuel powered internal combustion engines. Furthermore, when addressing the issue of miscibility, it fails to distinguish between fuel compositions which contain the lower $C_1$ and $C_2$ alcohols and compositions which contain no lower alcohols.

WO 92/20761 discloses compositions comprising biodiesel in which the base fuels are predominantly esters and alcohols. There is no mention in this document of reducing particulate matter from emissions.

Figure 1A:
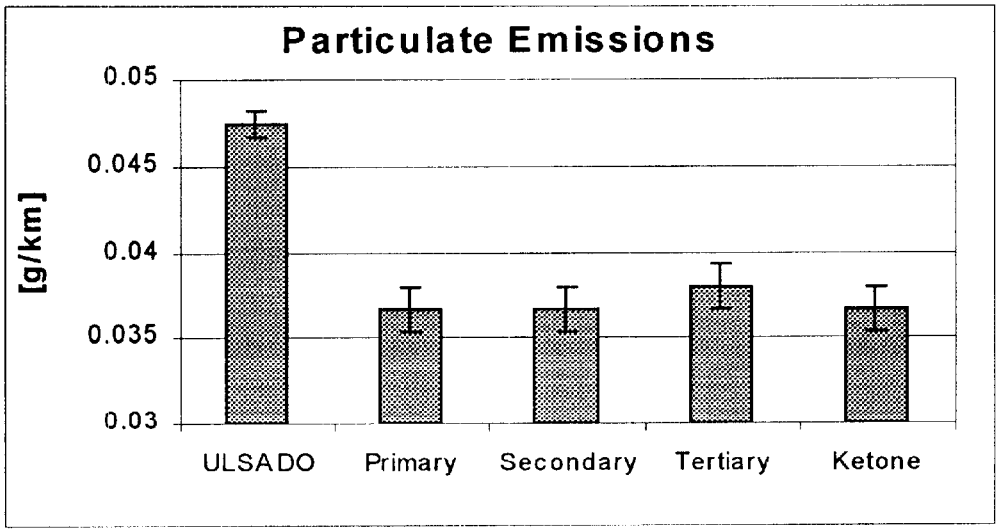
FIGS. 1A and 1B graphically present the data for absolute particulate matter (PM) and $NO_x$ emissions measured for a ULSADO base fuel and the base fuel containing 2% oxygen from primary, secondary and tertiary saturated aliphatic monohydric alcohol and ketone.

It has now been found that certain specific oxygenates when added to diesel fuels can enable the particulate emissions from the exhausts of engines powered by these fuels to be substantially reduced when compared with some of the additives used hitherto with little to no $NO_x$ increase.

Accordingly, an embodiment of the invention is a method of reducing particulate emissions from a vehicle powered by a diesel fuel composition comprising a major amount of a diesel fuel and having a base fuel which has no more than 10% by weight of olefins and no more than 10% by weight of esters, said method comprising blending with the composition greater than 5% by weight based on the total composition of at least one oxygenate selected from the group consisting of saturated, aliphatic monohydric primary, secondary, tertiary alcohol and mixture thereof having on an average from 4 to 20 carbon atoms, one or more mono- or poly-ketones or keto-monohydric aliphatic alcohol having on an average 5 to 25 carbons, and mixtures of the aforesaid alcohol(s) and ketone(s), said oxygenate containing no other oxygen in its structure, the oxygenate in the composition being sufficient to provide the fuel composition with at least 0.5% by weight of oxygen.

The diesel fuels that may be used in and benefit by the method of the addition of the aforesaid oxygenates comprise inter alia distillate fuels, and typically comprise a major amount of the diesel fuel which is preferably an ashless fuel.

The diesel fuel compositions are not intended to include fuels which contain substantial amounts of olefins (e.g., greater than 40% by weight) such as those produced in some of the Fischer-Tropsch processes. The fuel compositions contain no more than 10% by weight of olefins, suitably less than 5% by weight of olefins and preferably less than 2% by weight of olefins. Such fuels may be produced by modified Fischer-Tropsch processes to control the olefins formed therein to below the threshold levels now specified. Furthermore, the base fuel used has less than 10% by weight of esters, i.e., the base fuels do not include the so called biodiesels.

The diesel fuel suitably comprises $\geqq$70% by weight, preferably at least 80% by weight of the base fuel, more preferably greater than 85% by weight of the base fuel. The base fuel suitably contains greater than 1% by weight of aromatics, preferably greater than 5% by weight of aromatics and even more preferably from 5–20% by weight of aromatics. The base fuel suitably has a density below 855 $kg/m^3$, preferably no more than 835 $kg/m^3$. The base fuel suitably has a $T_{95}$ of no more than 345° C.

A feature of an embodiment of the invention is the use of at least 5% by weight of an oxygenate selected from the group consisting of at least one saturated alcohol selected from the group consisting of aliphatic monohydric primary, secondary, tertiary alcohol and mixture thereof having on an average 4–20 carbon atoms, one or more mono- or poly-ketones or keto-monohydric aliphatic alcohol having on an average 5 to 25 carbons, and mixtures of the aforesaid alcohol(s) and ketone(s), which is blended with the base fuel such that the final composition has an oxygen content of at least 0.5% by weight in order to reduce particulate emission when such a composition is used as a fuel in an internal combustion engine. It has been found that these alcohols, ketones and mixtures thereof when used in the amounts now specified are better at reducing emission of particulates from engine exhausts than the esters and ethers used hitherto. This improved performance in reducing particulate emission is achieved without recourse to the use of further additives such as, e.g., cyclohexane or peroxides or the use of aromatic alcohols. A further feature of the present invention is that these oxygenates are capable of an impressive performance with respect to particulate emissions over a broad range of vehicles and driving cycles when compared with the performance of esters, glycols and ethers used hitherto for this purpose which perform only over a restricted range of vehicles and driving cycles. A further feature of the present invention is that the particulate reduction is achieved with little to no increase in $NO_x$ emissions and also with a substantial decrease in CO emissions at high engine loads.

The saturated, aliphatic monohydric alcohols used in the method of an embodiment of the present invention are suitably primary, secondary and tertiary alcohols or mixtures thereof which may be straight chain alcohols, branched chain alcohols or mixtures thereof and are preferably branched chain alcohols whether used alone or as an admixture. The alcohols suitably have on an average from 5–20 carbon atoms, preferably from 6–20 carbon atoms and more preferably from 8–20 carbon atoms. Particularly preferred are alcohols having on average from 9–15 carbon atoms. The alcohols most preferred are open chain alcohols, such as, e.g., hexanol, isohexanol, methyl hexanol, 2-ethyl hexanol, octanol, isooctanol, nonanol, iso-nonanol, 2-propyl heptanol, 2,4-dimethyl heptanol, decanol, isodecanol, undecanol, isoundecanol, dodecanol, isododecanols, tridecanol, iso-tridecanol, tetradecanol, iso-tetradecanol, myristyl alcohol, hexadecanol, octadecanol, stearyl alcohol, isostearyl alcohol, eicosanol, dibutylcarbinol, tetrahydrolinalool, and mixtures thereof, especially Exxal®-10, Exxal®-12 and Exxal®-13. In these expressions the term "iso" is generally meant to indicate a mixture of branched alcohols. For instance, iso-nonanol represents a mixture containing approximately 85% 3,5,5-trimethyl hexanol, isodecanol represents a mixture of $C_9$–$C_{11}$, alcohols, isododecanol represents a mixture of $C_{11}$–$C_{13}$ alcohols, isotridecanol a mixture of $C_{12}$–$C_{14}$ alcohols and isotetradecanol is a mixture of linear and branched chain $C_{13}$–$C_{15}$ alcohols. Several of the alcohols referred to herein may be derived from natural sources. These alcohols, for instance, belong to two families, i.e., the lauric oils (primarily from coconut oil, palm kernel oil and jojoba oil) and the stearic oils. The lauric oils give rise to alcohols in the $C_6$–$C_{18}$ range peaking in $C_{12}$–$C_4$ (respectively $C_{12}$=lauryl alcohol and $C_{14}$ =myristyl alcohol) alcohols. The stearic oils led to alcohols in the $C_{14}$–$C_{22}$ range peaking in $C_{16}$–$C_{18}$ (respectively $C_{16}$=cetyl alcohol and $C_{18}$=stearyl alcohol) alcohols. Since these are generally produced by hydrogenation of the corresponding acids or methyl esters, these alcohols are considered to be saturated alcohols.

The term ketone includes mono- and poly-ketone and keto-monohydric aliphatic alcohols which may contain straight chain or branched chain aliphatic groups and mixtures thereof attached to the central carbonyl (C═O) group, or aromatic groups, or mixtures of aliphatic and aromatic groups, preferably one or both of the groups are aliphatic groups which may themselves be substituted with aryl moiety (e.g., phenyl, napthyl groups, etc.), preferably the alkyl groups are unsubstituted. The ketones suitably have on an average 5 to 25 carbon atoms, preferably on an average 5 to 21 carbon atoms, more preferably on an average of 7–21 carbons, still more preferably on an average of 7–17 carbons. Examples of suitable ketones include di-n-propyl ketone, cyclopentanone, cyclohexanone, methyl undecylketone, 8-pentadecanone, 2-heptadecanone, 9-eicosanone, 10 heneicosanone, and 2-doeicosanone as well as their alkyl derivatives and mixtures thereof. The ketones most preferred are open chain ketones such as di-ethyl ketone, methyl propyl ketone, methyl isopropyl ketone, ethyl propyl ketone, ethyl isopropyl ketone, di-n-propyl ketone, di-isopropyl ketone, isopropyl isobutyl ketone, di-n-butyl ketone, di-isobutyl ketone, di-n-pentyl ketone, di-isopentyl ketone, isobutyl isopentyl ketone, isopropyl isopentyl ketone, di-n-hexyl ketone, di-isohexyl ketone, isopentyl isohexyl ketone, and other ketones having aliphatic groups wherein each aliphatic group is independently a straight chain, singly branched chain or multiply branched chain aliphatic group. Also included are hydrocarbons with multiple ketone functions as well as mixed ketone and mono-hydric aliphatic alcohol functions (e.g., keto-monohydric alcohols), such keto-monohydric aliphatic alcohol materials having up to 25 carbons in total.

The amount of any of the alcohol, ketone or mixture thereof used in the method of the present invention is at least 5% by weight of the total fuel composition, and is such that it is capable of providing the composition with at least 0.5% w/w of oxygen, suitably at least 1.0% by weight of oxygen and preferably at least 2% by weight of oxygen. Thus to achieve this composition, the amount of oxygenate added to the composition is greater than 5% by weight of the total composition, and is suitably greater than 7% w/w and preferably from 7–60% by weight of the total composition. Typically, the alcohols, ketones or mixtures thereof are used in an amount in the range from 5 to 60% by weight, preferably from 7 to 40% by weight of the total fuel composition. Within these ranges, it would be possible to use a relatively low amount of a specific oxygenate or mixture of oxygenates, if said oxygenate or mixture of oxygenates has a relatively high oxygen content and conversely, one may have to use a higher amount of a particular oxygenate, or mixture of oxygenates, if it is relatively low in oxygen content.

The fuel compositions used in an embodiment of the invention are suitably substantially free of $C_1$–$C_2$ alcohols, i.e., they are present in an amount of <5% by weight, preferably ≦1% by weight, of the total composition. The $C_4$–$C_{20}$ alcohols and/or ketones used suitably have an acid value of no more than 0.1 mg KOH/g and a carbonyl number of no more than 0.35 mg KOH/g.

The diesel fuel composition may contain one or more conventional fuel additives, which may be added at the refinery, at the fuel distribution terminal, into the tanker, or as bottle additives purchased by the end user for addition into the fuel tank of an individual vehicle. These additives may include cold flow improvers (also known as middle distillate flow improvers), wax antisettling additives, diesel fuel stabilizers, antioxidants, cetane improvers, combustion improvers, detergents, demulsifiers, dehazers, lubricity additives, anti-foamants, anti-static additive, conductivity improvers, corrosion inhibitors, drag reducing agents, reodorants, dyes and markers, and the like.

The fuel compositions may additionally contain cetane improvers.

In the method of an embodiment of the present invention, the alcohols used in the fuel compositions were evaluated for their performance in reducing particulate emission using a single cylinder Caterpillar 3406 HD engine (which is a Cat 1Y450 engine) with gaseous emission analyses for: hydrocarbons, $NO_x$, carbon monoxide, carbon dioxide, oxygen (Horiba, Mexa-9100 DEGR) and a full flow dilution particulate tunnel (Horiba, DLS-9200). The particulates generated in the combustion process are collected on a 70 mm diameter Whatman GF/A glass fibre filter paper after the primary dilution tunnel. No secondary dilution is used. The filter papers used are stabilized and weighed both before and after testing. Stabilization conditions are at a temperature of 20± 2° C. and at a relative humidity of 45±10%. The difference in weight measured is taken to be the mass of particulate matter collected. The analytical and sampling systems for particulate collection conform to EEC Directive 88/77/EEC.

The performance of the compositions and additives in the method of embodiment of the invention are further illustrated with reference to the following Examples and Comparative Tests:

EXAMPLE 1

The reference fuel used as base fuel in the tests conducted below was that from Esso's Fawley refinery (hereafter referred to as "LSADO") and had the following characteristics:

| | |
|---|---|
| Density | 851 kg/m$^3$ |
| $KV_{20}$ (cSt) | 5.03 |
| Sulphur content | 400 ppm |
| $T_{95}$ | 343° C. |

In the Tables below by references to "Tech. Polyol Ester with branched acids" is meant an ester of technical pentaerythritol derived by reacting pentaerythritol with an isomeric mixture of branched C8 acids (isooctanoic acid sold as Cekanoic® 8 by Exxon Chemical Company) and branched C9 acids (3,5,5-trimethylhexanoic acid, sold as Cekanoic® 9 by Exxon Chemical Company) in the ratio of 1:5 by weight respectively such that the resultant ester had a hydroxyl number of 100–120 as measured by infra-red technique. The branched ester of Cekanoic® 8 acid has a molecular weight of 514 whereas that of Cekanoic® 9 has a molecular weight of 556. Similarly, references to "Tech. Polyol Ester with linear acids" is meant a mixed ester of technical pentaerythritol with a mixture or linear C8–C10 monocarboxylic acids derived from natural oils such as, e.g., coconut oil. Such a mixture of linear acids comprising 55% w/w of C8 acids, 40% w/w C10 acids and the remainder being C6 and C12 acids is available from Procter & Gamble. The linear ester of C8 linear acid has a molecular weight of 514 whereas that of the C10 linear acid has a molecular weight of 598.

The dimensions of the engine used for testing are shown in Table 1 below:

TABLE 1

| Engine | Cat 1Y540 |
|---|---|
| Bore (mm) | 137.2 |
| Stroke (mm) | 165.1 |
| Swept Volume (liters) | 2.43 |
| Compression ratio | 13.37:1 |
| Aspiration | Simulated turbo-charged |

oxygen content. Their emissions performance was compared against the LSADO base fuel which served as the reference fuel.

Two steady state conditions were chosen for testing, both at 1500 rpm. The high load condition was 220 Nm and the low load condition was 60 Nm. Each fuel was tested over five or six different days at each load in a randomized fuel test sequence for each day. Particulates were collected on two filter papers for 10 minutes each and these results were averaged to generate the data point for each fuel for each day.

The resultant particulate emissions are listed in Table 2 below for each fuel averaged over the 5–6 days of testing as a % change compared to the LSADO base fuel, the base diesel fuel containing 400 ppm sulphur. At high load, the amount of PM reduction was typically around 20%. The largest reduction in PM was 38% which was seen for the fuel containing the primary alcohol (Fuel 5). At low load, the amount of PM reduction seen was smaller. Again, the largest reduction in PM seen amongst any of the oxygenates tested was for the fuel containing the primary alcohol where a reduction of 16% was seen. These reductions in PM were obtained without increasing $NO_x$ emissions and with large reductions in CO emissions as seen from Table 2A below.

TABLE 2

% Change in Particulate Matter between Test Fuel and Reference LSADO

| Test Fuel | | Amount | PM g/k Wh | | % Change of PM over LSADO | |
|---|---|---|---|---|---|---|
| LSADO | Oxygenate Used | (%) | High Load | Low Load | High Load | Low Load |
| Fuel 1 | Trimethoxymethane | 4.5 | 0.1420 | 0.3998 | −20.6 | −2.7 |
| Fuel 2 | 2-Methoxy ethyl ether | 5.6 | 0.1332 | 0.3775 | −25.5 | −5.6 |
| Fuel 3 | Tech Polyol Ester with Branched Acids | 9.4 | 0.1495 | 0.3957 | −16.4 | −1.0 |
| Fuel 4 | Tech Polyol Ester with Linear Acids | 10.0 | 0.1455 | 0.3912 | −18.7 | −2.2 |
| Fuel 5* | Exxal ®-10 | 19.8 | 0.1110 | 0.3368 | −38.0 | −15.8 |
| Fuel 6 | Anisole | 13.5 | 0.1354 | 0.3461 | −24.3 | −13.4 |
| Fuel 7 | Methyl tert.-butyl ether | 11.0 | 0.1439 | 0.3784 | −19.6 | −5.4 |

*an embodiment of the invention

In the Tables the following abbreviations have been used:

LSADO—Low sulphur automotive diesel oil (ex Esso's Fawley refinery) as base fuel.

Exxal®10—Isodecanol (CAS No. 93821-11-5, EINECS No. 2986966, ex Exxon Chemicals)

Exxal®12—Isododecanol (CAS No. 90604-37-8, EINECS No. 2923309, ex Exxon Chemicals)

PM—Particulate Matter

Emissions testing was carried out in a single cylinder version of the Caterpillar 3406 heavy duty engine. A full dilution tunnel with primary dilution ratios of about 10:1 at high load and 15:1 at low load was used for particulate collection and analysis. Dynamic injection timing was kept constant for the range of fuels tested and the engine was supercharged using two external Roots pumps.

Seven oxygenated fuels were made by blending seven oxygenates into LSADO to make test fuels with 2 weight %

TABLE 2A

% Change in CO and $NO_x$ between Test Fuel and Reference LSADO

| | High Load | | Low Load | |
|---|---|---|---|---|
| Test Fuel + Oxygenate | CO | $NO_x$ | CO | $NO_x$ |
| Fuel 1 | −9.7 | 1.5 | 0.23 | 0.56 |
| Fuel 2 | −12.7 | 2.5 | 0.16 | 1.28 |
| Fuel 3 | −16.5 | 2.6 | 0.11 | 0.05 |
| Fuel 4 | −10.5 | 2.3 | −2.39 | 1.83 |
| Fuel 5 * | −22.7 | 1.2 | −1.13 | −2.25 |
| Fuel 6 | −11.0 | 6.2 | −1.58 | 4.80 |
| Fuel 7 | −7.7 | −1.0 | 2.65 | −2.73 |

* an embodiment of the invention

EXAMPLE 2

Emissions testing was also carried out in 3 passenger cars that spanned a range of vehicle technologies. The Ford Escort (1.8 liter IDI) represented the older vehicle technology and had no after-treatment. This vehicle was a typical vehicle sold from 1990–1991. The intermediate technology was the VW Jetta (1.6 liter IDI) that had turbo-charging and an oxidation catalyst and represented a state of the art vehicle in 1990–1991. The VW Golf (1.9 liter TDI) represented the newest vehicle technology and was turbo-charged, intercooled, had a closely mounted oxidation catalyst and used exhaust gas recirculation. It was a state of the art vehicle in 1996–1997.

Six oxygenated fuels were made by blending six oxygenates into LSADO to make test fuels with 2 weight % oxygen content as was described previously and whose compositions are given in Table 2 (Fuels 1, 3 to 7). The emissions performance of these oxygenated fuels was compared against LSADO which served as the reference fuel and this performance is shown in Table 3. The improvement in the particulate matter emissions over the reference fuel can be compared between these six fuels. In particular, the improvement using the primary monohydric alcohol compound in Fuel 5 can be compared with Fuels 1, 3, 4, 6, and 7 which contained various other oxygenated compounds.

Testing was done running the European hot ECE 15-EUDC test cycle. Each fuel was tested three times over the complete test cycle with a base fuel test completed before and after the three runs on the test fuel. Results for each test fuel are then expressed as a relative change from the base fuel data taken on the same day.

The resultant particulate emissions are listed below for each fuel for each of the three vehicles as a % change compared to LSADO, the base diesel fuel with 400 ppm sulphur. Note that for many of the fuels tested, the amount of particulate reduction varied widely between the three vehicles tested. Surprisingly, the results for the fuels with primary alcohol (Fuel 5) were extremely consistent showing a PM reduction of 18–20% over the ECE-EUDC test cycle. Again, no significant increase in $NO_x$ occurred for the fuel with the primary alcohol.

TABLE 3

% Change in Particulate Matter Between the Test Fuel and LSADO Reference Fuel

| Test Fuel + Oxygenate | Escort | Jetta | Golf |
|---|---|---|---|
| Fuel 1 | −9.8 | −6.5 | +4.5 |
| Fuel 3 | −0.1 | −2.7 | −9.1 |
| Fuel 4 | −3.8 | −9.3 | −2.0 |
| Fuel 5* | −18.9 | −18.2 | −19.6 |
| Fuel 6 | −19.0 | +10.8 | −13.4 |
| Fuel 7 | −18.4 | −10.2 | −11.6 |

*an embodiment of the invention

TABLE 3A

| | $NO_x$ DATA | | |
|---|---|---|---|
| Test Fuel + Oxygenate | Escort | Jetta | Golf |
| Fuel 1 | −0.1 | 3.2 | −1.6 |
| Fuel 3 | 6.5 | −2.2 | −1.9 |
| Fuel 4 | 5.3 | 4.2 | −2.3 |
| Fuel 5* | 1.2 | 2.5 | 0.9 |
| Fuel 6 | −0.4 | −5.2 | 10.3 |
| Fuel 7 | −10.1 | −3.1 | 1.9 |

*an embodiment of the invention

EXAMPLE 3

Emissions testing was carried out in a single cylinder version of the Caterpillar 3406 heavy duty engine. A full dilution tunnel with a primary dilution ratio of about 15:1 at low load was used for particulate collection and analysis. Dynamic injection timing was kept constant for the range of fuels tested and the engine was supercharged using two external Roots pumps.

Three alcohols were tested in LSADO blended to make test fuels with 2 weight % oxygen content. Their emissions performance was compared against the LSADO with 400 ppm sulphur which served as the reference fuel.

One steady state condition was chosen for testing at 1500 rpm and 60 Nm. Each fuel was tested over six different days in a randomized fuel test sequence for each day. Particulates were collected on two filter papers for 10 minutes each and these results were averaged to generate the data point for each fuel for each day.

The resultant particulate emissions are listed in Table 4 below for each fuel averaged over the six days of testing as a % change compared to LSADO, the base diesel fuel with 400 ppm sulphur. All three of these alcohols led to a particulate matter decrease of 17–19% compared to LSADO with no increase in $NO_x$.

TABLE 4

| | % Change in | |
|---|---|---|
| Test Fuel | PM | $NO_x$ |
| Exxal ®-10 in Fawley LSADO | −17.1 | −2.3 |
| Iso-Nonanol in Fawley LSADO | −18.8 | −2.0 |
| Exxal-12 in Fawley LSADO | −18.0 | −2.6 |

EXAMPLE 4

The base fuel used was a Fawley ULSADO, which had a density of 825 kg/m$^3$, a $kV_{20}$ of 3.41 cSt, a sulfur content of 31 ppm and a $T_{95}$ of 314° C., and this was blended with the appropriate amount of oxygenate to achieve an oxygen content in the final blend of 2% by weight. A primary alcohol, secondary alcohol, tertiary alcohol and ketone were selected for screening. The fuel details are shown in Table 5.

TABLE 5

| Blend Ref. | Fuel | Description | % wt oxygenate |
|---|---|---|---|
| | ULSADO | Base Fuel | 0 |
| TO | Base + Isodecanol | Primary: Exxal 10 | 18.74 |
| TL | Base + Dimethyl Heptanol | Secondary: Di-isobutyl carbinol | 18.0 |
| TN | Base + Dimethyl Octanol | Tertiary: Tetrahydrolinalool | 19.75 |
| TM | Base + Dimethyl Heptanone | Ketone: Di-isobutyl ketone | 17.75 |

Testing was carried out on a single vehicle. The VW Golf 1.9 TDI was selected. This vehicle is a 1.9 liter turbo-charged intercooled DI engine with an oxidation catalyst mounted very close to the engine block, exhaust gas recirculation, and an electronically controlled distributor fuel pump with a needle lift sensor allowing for closed loop control of injection timing.

The fuel blends were tested according to a specific test protocol and involved testing a base fuel against a different test fuel each day. The base fuel was tested first followed by the test fuel which was tested three times in succession followed by a final base fuel test (base1, test1, test2, test3, base2). Each of these five tests comprised a hot ECE+EUDC drive cycle. Gaseous and particulate emissions were collected for each test.

Results and Discussion

Figure 1B:
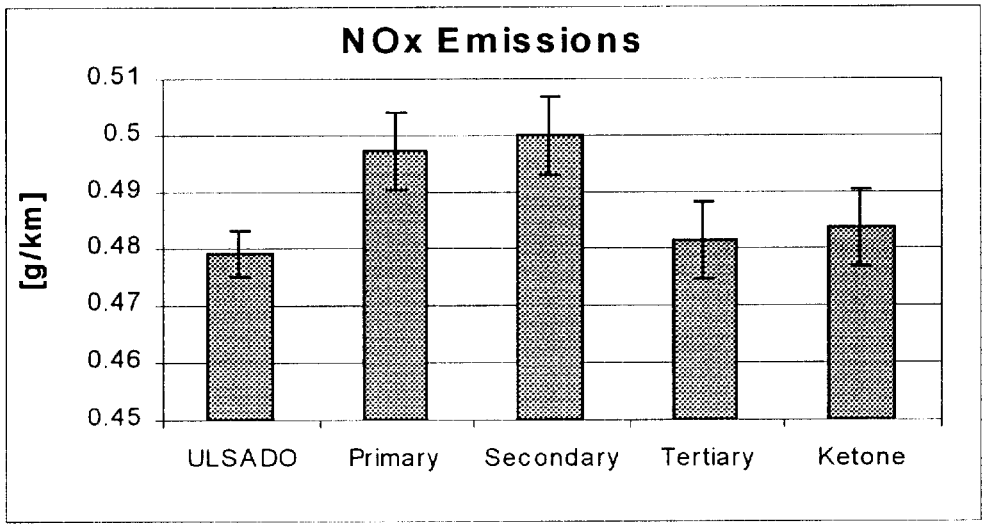

Shown in FIGS. 1A and 1B and Table 6 are the data for absolute PM and $NO_x$ emissions measured for each fuel. In the Figures the bars show the 95% least significant difference limits and if these do not overlap then there is said to be significant difference between fuels. All 4 oxygenates showed substantial and significant reductions in particulate emissions relative to the base ULSADO fuel. There was no statistically significant difference between the type of oxygenates used. All 4 oxygenated blends also generated higher absolute emissions of $NO_x$ than for the ULSADO. However, for the tertiary alcohol and the ketone these increases were only small and not statistically significant at the 95% level, as compared with the base fuel ULSADO.

Figure 2:
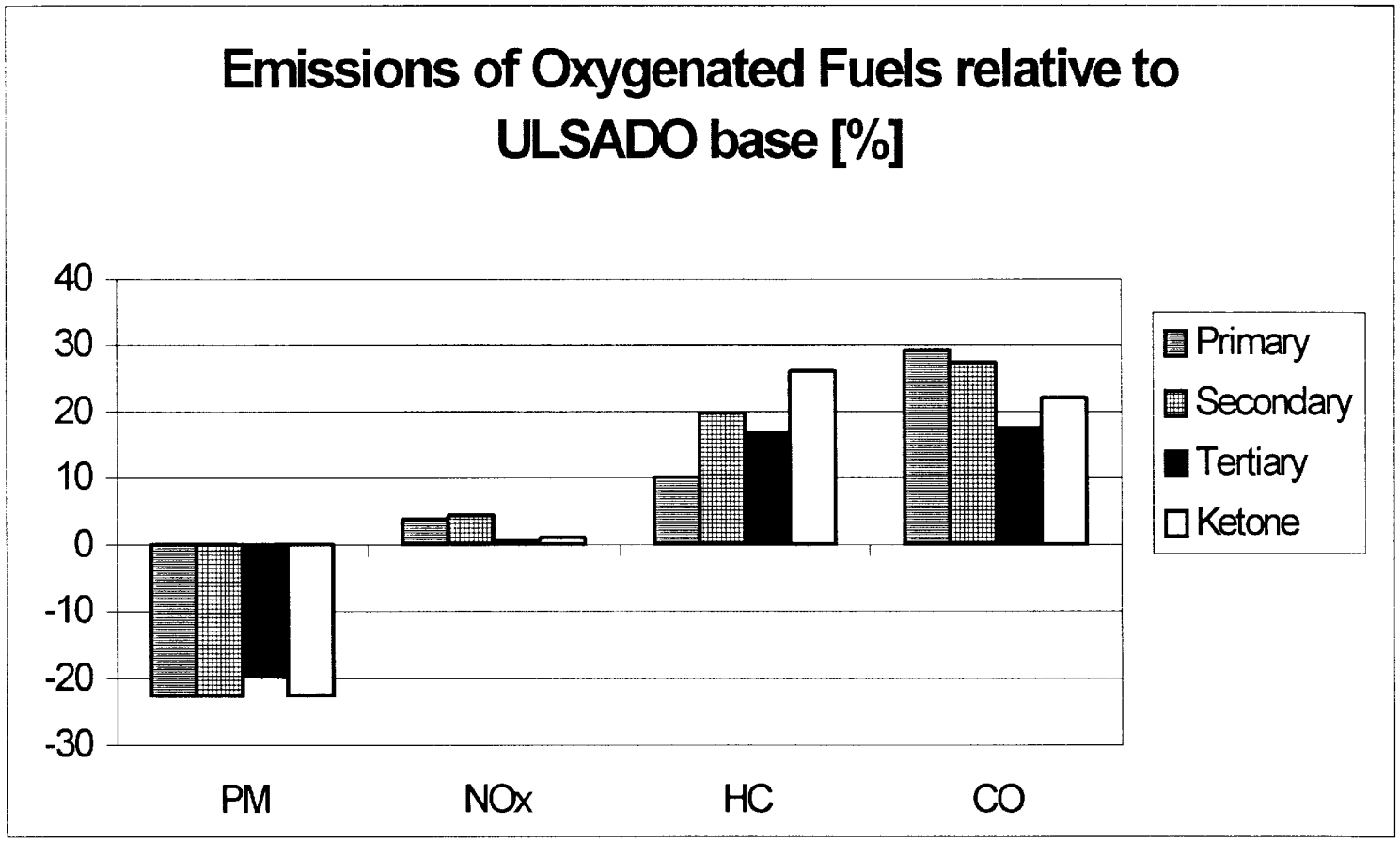
FIG. 2 graphically presents and compares the emissions data relating to PM, $NO_x$, HC, and CO for ULSADO fuel additized with primary, secondary and tertiary saturated aliphatic monohydric alcohols and ketone.

FIG. 2 and Table 6 shows the relative change in emissions of each oxygenated blend compared with the base fuel. The differences observed from FIGS. 1A and 1B are clearly represented here. Reductions in particulate emissions varied from 19.8% (tertiary alcohol) to 22.6% (primary & secondary alcohols and ketone). The corresponding increases in $NO_x$ emissions relative to ULSADO were 0.5% (tertiary), 1.0% (ketone), 3.8% (primary) and 4.4% (secondary). The addition of an oxygenate to the base diesel fuel also had the effect of increasing HC and CO emissions, although these can be more easily controlled using an oxidation catalyst, now common on all light-duty diesel vehicles. The increase in HC and CO emissions do not outweigh the significance and importance of the reduction in particulate matter.

TABLE 6

| Fuel | CO g/km | $CO_2$ g/km | HC g/km | $NO_x$ g/km | PM g/km |
|---|---|---|---|---|---|
| ULSADO | 0.230 | 130.1 | 0.064 | 0.479 | 0.047 |
| Primary | 0.297 | 128.5 | 0.071 | 0.497 | 0.037 |
| Secondary | 0.292 | 128.4 | 0.077 | 0.500 | 0.037 |
| Tertiary | 0.270 | 129.4 | 0.075 | 0.481 | 0.038 |
| Ketone | 0.280 | 128.2 | 0.081 | 0.484 | 0.037 |

Difference from ULSADO base [%]

| Fuel | CO | $CO_2$ | HC | $NO_x$ | PM |
|---|---|---|---|---|---|
| Primary | 29.27095 | −1.2042 | 9.98703 | 3.827418 | −22.6033 |
| Secondary | 27.23975 | −1.28107 | 19.84436 | 4.384134 | −22.6033 |
| Tertiary | 17.51904 | −0.56367 | 16.73152 | 0.487126 | −19.7889 |
| Ketone | 22.01668 | −1.46042 | 26.07004 | 0.974252 | −22.6033 |

This data demonstrates that secondary and tertiary alcohols and ketone produce a similar level of reduction in particulate emissions from base fuel to that previously demonstrated with a primary alcohol.

What is claimed is:

1. A method of reducing particulate emissions from a vehicle powered by a diesel fuel composition comprising a major amount of a diesel fuel having a base distillate fuel which contains no more than 10% by weight of olefins and no more than 10% by weight of esters, said method comprising blending with the composition at least 5% by weight based on the total composition of an additive for reducing particulate emissions consisting essentially of at least one oxygenate selected from the group consisting of saturated, aliphatic monohydric primary, secondary or tertiary alcohol and mixtures thereof having on an average from 4 to 20 carbon atoms, one or more mono- or poly-ketones or keto-monohydric aliphatic alcohols having on an average 5 to 25 carbons, and mixtures of the aforesaid alcohol(s) and ketone (s) said oxygenate containing no other oxygen in its structure, the amount of the oxygenate in the composition being sufficient to provide the fuel composition with at least 2% by weight of oxygen.

2. The method according to claim 1 wherein the fuel is a distillate fuel comprising a major amount of diesel fuel which is ashless.

3. The method according to claim 1 wherein the alcohol has on an average from 6–20 carbon atoms.

4. The method according to claim 1 wherein the alcohol has on an average from 8–20 carbon atoms.

5. The method according to claim 1 wherein the ketone is an aliphatic ketone.

6. The method according to claim 1 or 5 wherein the ketone has on average from 5 to 21 carbon atoms.

7. The method according to claim 1 or 5 wherein the ketone has an average from 7 to 15 carbon atoms.

8. The method according to claim 1 wherein the alcohol is selected from hexanol, methyl hexanol, 2-ethyl hexanol, octanol, isooctanol, nonanol, iso-nonanol, 2-propyl heptanol, 2,4-dimethyl heptanol, decanol, isodecanol, undecanol, isoundecanol, dodecanol, isododecanol, tridecanol, iso-tridecanol, tetradecanol, iso-tetradecanol, myristyl alcohol, hexadecanol, octadecanol, stearyl alcohol, isostearyl alcohol, eicosanol, di-isobutyl carbinol, tetrahydrolinalool, and mixtures thereof.

9. The method according to claim 1 wherein the amount of oxygenate used to provide the composition with at least 2% by weight of oxygen is in the range from 7 to 60% by weight based on the total fuel composition.

10. The method according to claim 1 wherein the diesel composition comprises at least 80% by weight of the base fuel.

11. A method for reducing CO emissions without any substantial increase in $NO_x$ from a vehicle powered under high load conditions by a diesel fuel composition comprising a major amount of the diesel fuel having a base distillate fuel which contain no more than 10% by weight of olefins as base stock and no more than 10% by weight of an ester, said method comprising blending with the composition at least 5% by weight based on the total composition of an additive consisting essentially of at least one oxygenate selected from the group consisting of saturated, aliphatic monohydric primary, secondary, tertiary alcohol and mixtures thereof having on an average from 4 to 20 carbon atoms, one or more mono- or poly-ketones or keta-monohydric aliphatic alcohol having on an average 5 to 25 carbons, and mixtures of the aforesaid alcohol(s) and ketone (s), said oxygenate containing no other oxygen in its structure, the amount of the oxygenate in the composition being sufficient to provide the fuel composition with at least 2% by weight of oxygen.

* * * * *